US005375632A

United States Patent [19]

Corona

[11] Patent Number: 5,375,632

[45] Date of Patent: Dec. 27, 1994

[54] COMPRESSED AIR AEROSOL BOMBS OF IMPROVED TYPE AND APPARATUS FOR REFILLING THE SAME

[76] Inventor: Patrizia Corona, Via Paolo Paruta, 64, 35126 Padova, Italy

[21] Appl. No.: 38,094

[22] Filed: Mar. 30, 1993

[30] Foreign Application Priority Data

Apr. 1, 1992 [IT] Italy ..... RM92A000236

[51] Int. Cl.[5] ..... B65B 3/04

[52] U.S. Cl. ..... 141/20; 141/3; 141/46; 141/319; 141/266

[58] Field of Search ..... 141/3, 20, 46, 67, 319, 141/266, 250

[56] References Cited

U.S. PATENT DOCUMENTS

| | | | |
|---|---|---|---|
| 2,684,805 | 7/1954 | McBean | 141/20 X |
| 3,211,191 | 10/1965 | Howisch | 141/20 |
| 3,601,164 | 8/1971 | Bruce | 141/20 |
| 3,765,459 | 10/1973 | Morse | 141/20 |
| 3,817,297 | 6/1974 | King | 141/20 |
| 3,937,257 | 2/1976 | Biro | 141/3 |
| 4,938,260 | 7/1990 | Hirz | 141/20 |
| 5,092,750 | 3/1992 | Leroy et al. | 141/20 X |

FOREIGN PATENT DOCUMENTS

| | | | |
|---|---|---|---|
| 0410947 | 1/1991 | European Pat. Off. . | |
| 0419261 | 3/1991 | European Pat. Off. . | |
| 3307245 | 9/1984 | Germany | 141/20 |
| 8907388 | 10/1990 | Germany . | |
| 1111534 | 5/1968 | United Kingdom . | |

*Primary Examiner*—Ernest G. Cusick

*Attorney, Agent, or Firm*—Stevens, Davis, Miller & Mosher

[57] ABSTRACT

The apparatus for refilling compressed air aerosol bombs, or sprayers, comprises a reservoir (2), for containing the active substance to be charged, in which is immersed a refiller tank (4) capable of containing a quantity of active substance not greater than a single charge of an aerosol bomb, which tank is endowed with a check valve (6) for the inlet of the active substance from the reservoir, a pipe (16) for the inlet of compressed air from the outside, and a suction pipe (10) ending in a quick connection valve of male or female type (8) for the connection with a corresponding valve of a respective female or male type provided on the bottom of the bomb which is to be refilled. The latter has a beak shaped head where the atomizer valve is assembled with a quick slipping off connection (52).

20 Claims, 2 Drawing Sheets

COMPRESSED AIR AEROSOL BOMBS OF IMPROVED TYPE AND APPARATUS FOR REFILLING THE SAME

BACKGROUND OF THE INVENTION

1. Field of the Invention

The present invention relates to compressed air refillable aerosol bombs, or atomizers, also know as "sprayers", and to an apparatus for refilling the same.

2. Description of Related Art

An apparatus for refilling compressed air aerosol bombs is known from the European Patent Application No. 0,410,947 of the same Applicant. It substantially comprises a closed reservoir which contains the liquid constituting the active substance to be sprayed and which employs, as propellant, compressed air which is blown into its interior at a determined pressure. The reservoir is endowed with a sucker pipe ending in a quick connection valve of male or female type which is to be connected to a corresponding female or male connection valve borne by the aerosol bomb which must be refilled. Means for controlling the pressure in the reservoir and means for delivering compressed air directly into the bomb complete the apparatus.

Such a refiller apparatus has the drawback of necessitating, for its operation, the pressurization of a reservoir of considerable size; this involves safety measures dictated by regulations which require homologation or approval and routine inspections of the reservoir by the responsible entity.

Moreover, the amount of liquid which is let into the bomb cannot be predetermined exactly and is adjustable only with the counterpressure produced inside the bomb itself.

Summary of the Invention

A first object of the present invention is to overcome these drawbacks i.e. to provide an apparatus for refilling compressed air aerosol bombs, the operation of which involves pressurization of a reservoir of a limited enough size so as not to involve safety problems, and allows determination of the quantity of liquid to be let in.

Another object of the present invention is to provide more functional and safe compressed air sprayer bombs refillable with the above mentioned apparatus, by endowing them with a means making the atomizer valve easily replaceable in case of clogging or wear, and contemporaneously protecting the bleed valve so as to render its accidental activation difficult.

The objects mentioned above are achieved according to the present invention with an apparatus for refilling compressed air aerosol bombs, comprising in combination:

- a large capacity reservoir, not subject to any pressurization, for the active substance;
- a refiller tank of such a capacity as to contain a quantity of active substance not greater than the charge of an aerosol bomb; said refiller tank being completely immersed in said reservoir and receiving the active substance contained in it through a check-valve;
- a pipe for letting compressed air into said refiller tank, and
- a suction pipe ending in a quick connection valve of male or female type and establishing a fluid communication between said refiller tank and the aerosol bomb to be refilled; said bomb is endowed, to this end, with a corresponding female or male valve.

It is apparent that by limiting the capacity of the pressurized reservoir to a single charge of the aerosol bomb, its size does not create any safety consideration; the apparatus thus achieves the object of the present invention.

With respect to the bomb, the present invention provides a particular beak shaped head from which the atomizer valve and the sucker stem may be slipped off using simple pressure and the bleed valve is protected against shocks.

BRIEF DESCRIPTION OF THE DRAWINGS

The present invention will be better understood on the basis of the following detailed disclosure of its preferred embodiment, which is intended only as an example and not, to limit the invention, and is considered with reference to the annexed drawings, wherein.

DESCRIPTION OF THE PREFERRED EMBODIMENT

Figure 1:
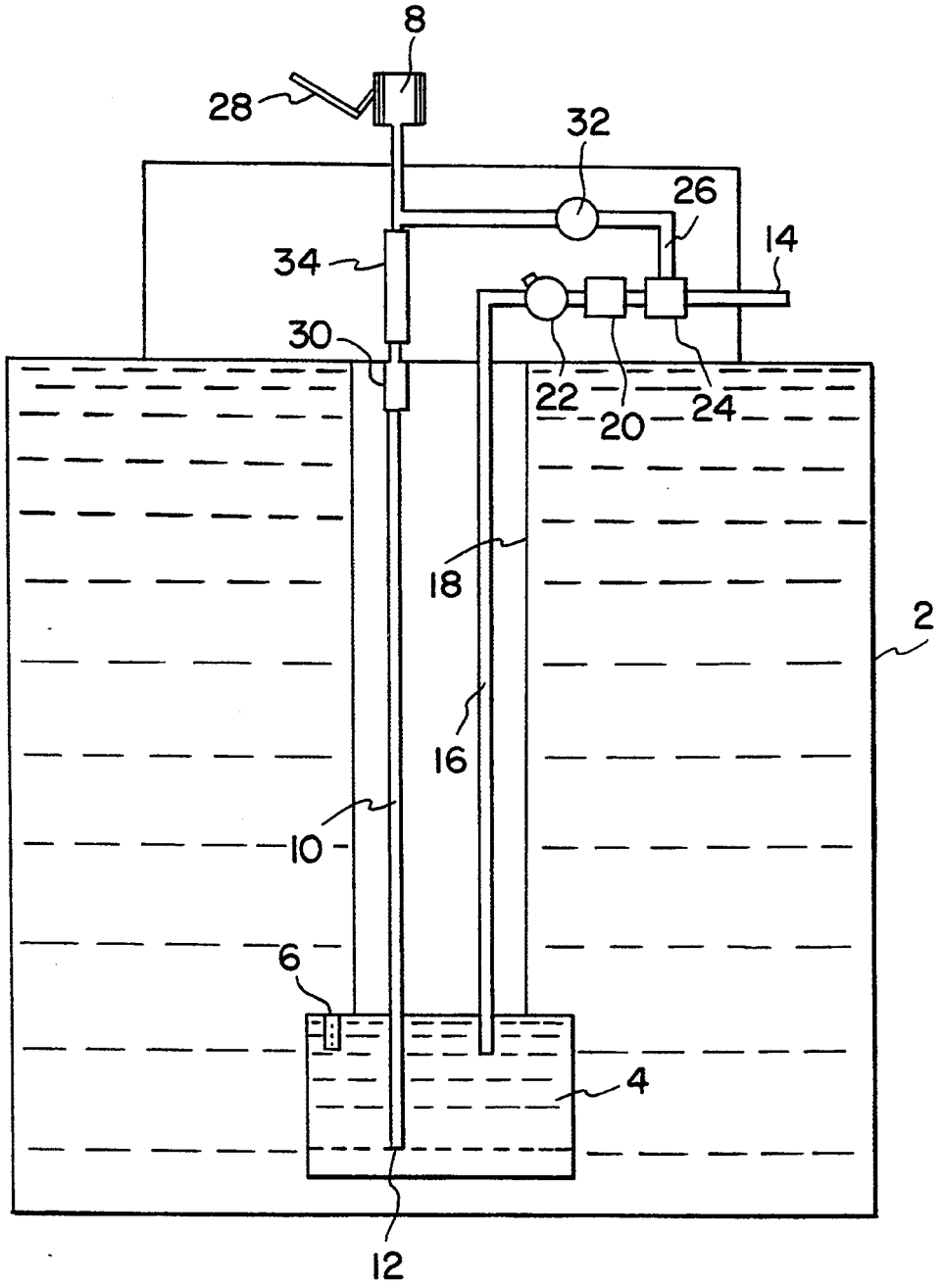
FIG. 1 schematically represents the refiller apparatus for compressed air aerosol bombs according to the present invention.

With reference to FIG. 1, it can be observed that the apparatus comprises a refiller tank 4 which in its operating condition, that is to say when it is ready for use, contains the liquid constituting the active substance to be sprayed. The capacity of the tank 4 is such as to contain active substance in a quantity not greater than a charge of the refillable aerosol bomb 36 of FIG. 2.

The tank 4 is immersed in an active substance reservoir 2, from which tank 4, once emptied, is fed through a check-valve 6. The extremity 12 of suction pipe 10 is introduced into the tank 4 by means 34 e.g. an adjustable sleeve; suction pipe 10 has at the other extremity a quick connection valve of male or female type 8, which is to be connected to a quick connection valve (not shown) of female or male type respectively, provided on the bottom of the bomb 36 to be refilled.

The refilling of the bomb 36 is effected by letting low pressure (1–2 atm) compressed air into the refiller tank 4, by opening a three way (or slider) tap 22 connected with a low pressure regulator 20 arranged on an air feeder line 14 said tap 22 and regulator 20 being, downstream of a first high pressure regulator 24 which limits the pressure of the air coming from any external air source (not shown). The line 14 is extended into the refiller tank 4 through a pipe 16. In the closed position tap 22 prevents air from entering pipe 16, but allows tank 4 to communicate with the outside. In the open position the tap puts line 14 in communication with pipe 16 and impedes bleeding to the outside.

All of the liquid down to the level of the extremity 12 of pipe 10 thus enters the bomb. At this point one brings three way tap 22 again into the closed position allowing bleeding of the refiller tank 4; in accordance with the principle of communicating vessels, the tank fills itself again for the next use.

Suction pipe 10 and air feeding pipe 16 reach the refiller tank through a steel pipe 18 which isolates them from the liquid contained in the reservoir 2.

The amount of active substance to be charged into the bomb is determined by the depth of immersion of the free end 12 of suction pipe 10 in the refiller tank 4.

The pressures are monitored through a pressure indicator, not shown.

After charging the liquid in the bomb 36, with the three way tap 22 in its original closed position, one opens tap 32 thus letting in the more highly pressurized air which acts as the impetus for atomization, through the first pressure regulator 24, which is connected with branch 26 to quick connection valve 8. The inlet to the refiller tank through suction pipe 10 is obstructed by a check valve 30.

After also closing tap 32, the bomb is disconnected from the refiller tank by a quick disconnection lever 28, which, as already mentioned in the aforementioned European Patent Application No. 0,410,947, is known to those skilled in the art.

Figure 2:
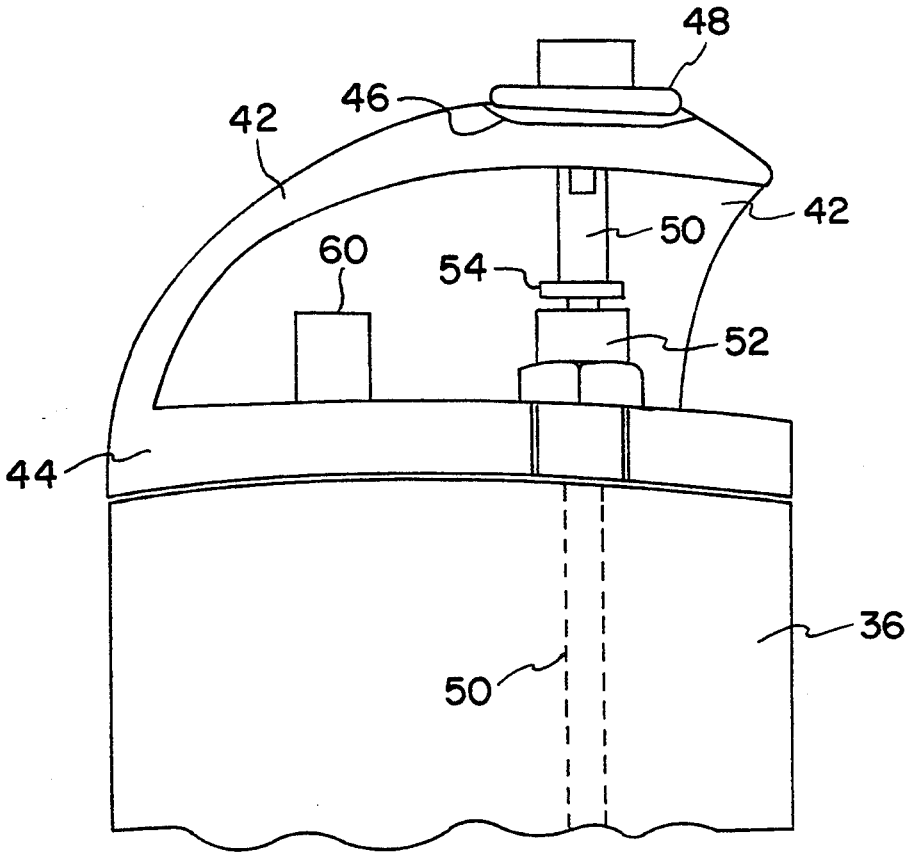
FIG. 2 is a perspective view of the refillable sprayer bomb according to the present invention.

FIG. 2 schematically shows the head of the refillable bomb utilized in combination with the apparatus disclosed above. This head enables the use of atomizer valves of commercial type as well as quick replacement in case of clogging and/or wear, by providing a support and protection element 42 that protrudes like a beak and overhangs a flat base 44 that closes the upper end of the refillable bomb. Element 42 has a seat 46 with a central through hole which houses atomizer valve 48 removably from above together with the respective suction pipe 50. The suction pipe 50 is introduced into the bomb through a quick connection 52, of known type, which, as a result of the internal pressure of the bomb, keeps it locked in situ under safety measures through a not visible O-ring. The pipe and the annexed atomizer valve 48 may be slipped off by simply pushing collar 54 which counters the internal O-ring downward.

In order to avoid accidentally bleeding the bomb, the bleed valve 60 is positioned on base 44 close to the vertical wall of element 42, and therefore protected on the upper side by the upper beak of the element itself.

The present invention has been disclosed with reference to a preferred embodiment, but it will be apparent to those skilled in the art that modifications and/or additions can be made thereto, without departing from the scope of protection defined by the enclosed claims.

For instance, one can operate through a single pressure regulator making the propellant more highly pressurized air pass through refiller tank 4 and once the bomb 36 has been disconnected, one can reconnect the tank 4 with the outside through a three way tap, allowing bleeding and refilling.

I claim:

1. An apparatus for refilling compressed air aerosol bombs or sprayers, comprising an aerosol bomb quick connector valve (8), a closed refiller tank (4), a non-pressurized active substance reservoir (2) into which said refiller tank (4) is completely immersed, a check valve (6) interconnecting the interior of said active substance reservoir (2) with the interior of said refiller tank (4), first means communicating with said refiller tank (4) to inject air into said refiller tank (4) and second means to convey air and active substance to said aerosol bomb quick connector valve (8), said aerosol bomb quick connector valve (8) being in communication with said refiller tank (4) and connectable to said compressed air aerosol bomb or sprayer.

2. The apparatus of claim 1 wherein said first means to inject air to said refiller tank (4) includes an air feed line (14), a three way valve (22) and a low pressure regulator (20) mounted in said air feed line (14), said valve (22) having a first position which permits air to flow at low pressure into said refiller tank (4) and force active substance into said compressed air aerosol bomb or sprayer.

3. The apparatus of claim 2 wherein said three way valve (22) has a second position open to the atmosphere to permit bleeding of air from said refiller tank (4) to said atmosphere and permit active substance from said active substance reservoir (2) to enter filler tank (4) through said check valve (6).

4. The apparatus of claim 1 including a third means for passage of air under high pressure, said third means passing air to said compressed air aerosol bomb or sprayer, said third means comprising a bypass line (26) a tap (32) and a high pressure regulator (24), said tap (32) and said high pressure regulator (24) being positioned in said bypass line (26) which bypass line (26) is connected to said second means and said air feed line (14).

5. The apparatus of claim 1 wherein said first means to inject air to said refiller tank (4) includes an air feed line (14), a three way valve (22) and a high pressure regulator (24) mounted in said air feed line (14) which said valve (22) in a first position permits air under high pressure to enter said refiller tank (4) and force active substance into said compressed air aerosol bomb or sprayer.

6. The apparatus of claim 4 wherein said high pressure regulator (24) is adjustable.

7. The apparatus of claim 4 wherein said high pressure regulator (24) is adjustable.

8. The apparatus of claim 1 wherein said second means includes an adjustable pipe (10) having an end (12) positioned in said refiller tank (4) for adjusting the quantity of active substance to be introduced into said compressed air aerosol bomb or sprayer.

9. A refillable compressed air aerosol bomb or sprayer connectable to the apparatus of claim 1 which has connected to said compressed air aerosol bomb or sprayer a removable atomizer valve (48) and a bleed valve (60), said compressed air aerosol bomb or sprayer further comprising a head (42) connected to a base (44) which base (44) carries a connection device (52) and collar (54), said device (52) preventing depressurization of said compressed air aerosol bomb or sprayer by exerting pressure on said collar (54) while changing said atomizer valve (48).

10. The apparatus of claim 2 including a third means for passage of air under high pressure to said compressed air aerosol bomb or sprayer, said third means comprising a tap (32) and a high pressure regulator (24) in said bypass line (26) which is connected to said second means.

11. The apparatus of claim 3 including a third means for passage of air under high pressure to said compressed air aerosol bomb or sprayer, said third means comprising a tap (32) and a high pressure regulator (24) in said bypass line (26) which is connected to said second means.

12. The apparatus of claim 3 wherein said first means to inject air to said refiller tank (4) includes an air feed line (14), a three way valve (22) and a high pressure regulator (24) mounted in said air feed line (14) which said valve (22) in a first position permits air under high pressure to enter said refiller tank (4) and force active substance into said compressed air aerosol bomb or sprayer.

13. The apparatus of claim 4 wherein said high pressure regulator (24) is mounted in an air feed line (14) to enable air under high pressure to enter refiller tank (4).

14. The apparatus of claim 2 wherein said second means includes an adjustable pipe (10) having an end (12) positioned in refiller tank (4) for adjusting the quantity of active substance to be introduced into said compressed air aerosol bomb or sprayer.

15. The apparatus of claim 3 wherein said second means includes an adjustable pipe (10) having an end (12) positioned in refiller tank (4) for adjusting the quantity of active substance to be introduced into said compressed air aerosol bomb or sprayer.

16. The apparatus of claim 4 wherein said second means includes an adjustable pipe (10) having an end (12) positioned in refiller tank (4) for adjusting the quantity of active substance to be introduced into said compressed air aerosol bomb or sprayer.

17. The apparatus of claim 5 wherein said second means includes an adjustable pipe (10) having an end (12) positioned in refiller tank (4) for adjusting the quantity of active substance to be introduced into said compressed air aerosol bomb or sprayer.

18. A refillable compressed air aerosol bomb or sprayer connectable to the apparatus of claim 2 which has connected to said compressed air aerosol bomb or sprayer a removable atomizer valve (48) and a bleed valve (60), said compressed air aerosol bomb or sprayer further comprising a head (42) connected to a base (44) which base (44) carries a connection device (52) and collar (54), said device (52) preventing depressurization of said compressed air aerosol bomb or sprayer by exerting pressure on said collar (54) while changing said atomizer valve (48).

19. A refillable compressed air aerosol bomb or sprayer connectable to the apparatus of claim 3 which has connected to said compressed air aerosol bomb or sprayer a removable atomizer valve (48) and a bleed valve (60), said compressed air aerosol bomb or sprayer further comprising a head (42) connected to a base (44) which base (44) carries a connection device (52) and collar (54), said device (52) preventing depressurization of said compressed air aerosol bomb or sprayer by exerting pressure on said collar (54) while changing said atomizer valve (48).

20. A refillable compressed air aerosol bomb or sprayer connectable to the apparatus of claim 4 which has connected to said compressed air aerosol bomb or sprayer a removable atomizer valve (48) and a bleed valve (60), said compressed air aerosol bomb or sprayer further comprising a head (42) connected to a base (44) which base (44) carries a connection device (52) and collar (54), said device (52) preventing depressurization of said compressed air aerosol bomb or sprayer by exerting pressure on said collar (54) while changing said atomizer valve (48).

* * * * *